US012043440B2

(12) United States Patent
Dueweke

(10) Patent No.: US 12,043,440 B2
(45) **Date of Patent: *Jul. 23, 2024**

(54) AUTOMATED CLOSING SYSTEMS

(71) Applicant: Sesh Technologies Manufacturing Inc., Spokane, WA (US)

(72) Inventor: Jason Dueweke, Deer Park, WA (US)

(73) Assignee: Sesh Technologies Manufacturing Inc., Spokane, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/323,274

(22) Filed: May 24, 2023

(65) Prior Publication Data

US 2023/0382587 A1 Nov. 30, 2023

Related U.S. Application Data

(63) Continuation of application No. 17/462,515, filed on Aug. 31, 2021, now Pat. No. 11,697,519.

(51) Int. Cl.

| | |
|---|---|
| ***B65B 25/14*** | (2006.01) |
| ***B65B 7/28*** | (2006.01) |
| ***B65B 57/00*** | (2006.01) |
| ***B65B 63/02*** | (2006.01) |

(52) U.S. Cl.

CPC ..... *B65B 63/02* (2013.01); *B65B 7/28* (2013.01); *B65B 25/146* (2013.01); *B65B 57/00* (2013.01)

(58) Field of Classification Search

USPC ..... 53/523

See application file for complete search history.

(56) References Cited

U.S. PATENT DOCUMENTS

| | | | | |
|---|---|---|---|---|
| 4,884,602 | A * | 12/1989 | Yamamoto | A61J 3/074 141/238 |
| 5,230,207 | A | 7/1993 | Hartzell et al. | |
| 2016/0120212 | A1 | 5/2016 | Heidtmann | |
| 2019/0320709 | A1 | 10/2019 | Kaufmann et al. | |
| 2020/0054066 | A1 | 2/2020 | Kaufmann et al. | |
| 2022/0175020 | A1 | 6/2022 | Holderman et al. | |
| 2022/0267035 | A1 * | 8/2022 | Garthaffner | B65B 5/06 |
| 2023/0063615 | A1 | 3/2023 | Dueweke | |
| 2024/0044694 | A1 | 2/2024 | Dueweke | |

FOREIGN PATENT DOCUMENTS

WO WO2019140237 7/2019

OTHER PUBLICATIONS

Office Action for U.S. Appl. No. 17/462,515, mailed on Dec. 22, 2022, Dueweke, "Automated Closing Systems", 17 Pages.

* cited by examiner

*Primary Examiner* — Chinyere J Rushing-Tucker
(74) *Attorney, Agent, or Firm* — Lee & Hayes, P.C.

(57) ABSTRACT

Systems and methods for an automated paper cone closing machine are disclosed. A paper cone closing machine may comprise a plurality of tamping rods, a pair of plates, and a plurality of ejection rods arranged above a tray shuttle. The plurality of tamping rods for compacting a material contained in a plurality of paper rolls removeably received in the tray shuttle in a row. The pair of plates for pressing on the top of each paper roll to flatten the top of each paper roll into a flap. The plurality of ejection rods configured to press on the flap of each paper roll to press the flap into a top of each paper roll into a dimple thereby closing each paper roll.

20 Claims, 6 Drawing Sheets

AUTOMATED CLOSING SYSTEMS

CROSS-REFERENCE TO RELATED APPLICATION

The present disclosure is a continuation of, and claims priority under 35 U.S.C. § 120, to U.S. patent application Ser. No. 17/462,515 filed Aug. 31, 2021, the disclosure of which is hereby incorporated by reference in its entirety.

BACKGROUND

Machines may be used to automate manufacturing processes. Machines may be designed to produce a manufactured product comprising delicate materials that are required to be combined in a specific manner. Described herein are improvements in technology and solutions to technical problems that may be used to, among other things, enhance the experience for users producing a manufactured product.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference numbers in different figures indicates similar or identical items. The systems depicted in the accompanying figures are not to scale and components within the figures may be depicted not to scale with each other.

DETAILED DESCRIPTION

Figure 1:
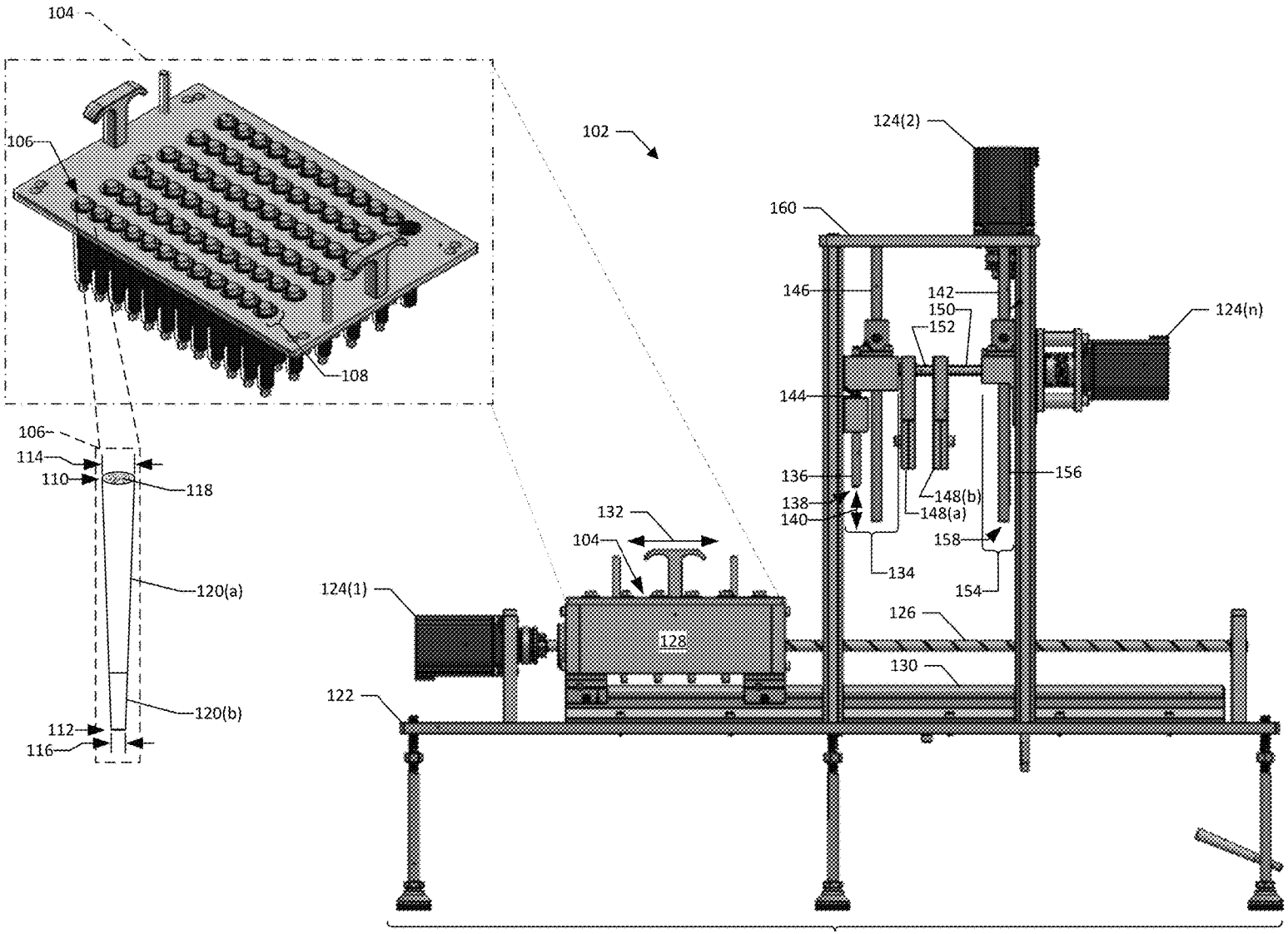
FIG. 1 illustrates a side view of an example automated paper roll closing machine system according to an embodiment of the instant application.

This disclosure is directed to an automated paper roll closing machine (hereinafter, "the closing machine") and systems for use thereof. Take for example, an environment having processed agricultural material (hereinafter, "the material") where one or more users reside. Such users may desire to package a desired quantity of the material by themselves for repurpose use. Such desired packaging may be paper rolls having established standardized shapes, sizes, and/or components for repurpose use. However, such a desired packaging may be time consuming and/or difficult to close by hand. The closing machine may be configured with various components for closing a paper roll formed of a paper-like material having a shape, size, and/or components for repurpose use. In some examples, the shape of the paper roll may be substantially conical. In some examples, the paper-like material may be comprised of at least one of refined white paper, unrefined brown paper, recycled paper, hemp paper, palm leaf, and/or anything containing substantially similar qualities. In some examples, the paper roll may include a paper-like support material disposed therein. In some examples, the support material may be substantially cylindrical and/or conical in shape. In some examples, the support material may have a more favorable rigidity than the paper-like material used to shape the paper roll, such that the support material provides substantial support for at least a portion of the paper roll. In some examples, the support material may be comprised of at least one of refined white paper, unrefined brown paper, recycled paper, hemp paper, palm leaf, and/or anything containing substantially similar qualities. Additionally, or alternatively, the support material may be configured to obstruct the processed agricultural material while allowing for air to pass therethrough.

The components of the closing machine may be arranged in various combinations and/or orientations. The closing machine may be configured with a variety of closing and/or transporting mechanism configurations including various components. An example closing mechanism may be configured such that the material contained in a plurality of paper rolls is compacted. For example, a tamping system may be configured to compact the material contained in the plurality of paper rolls. Another example closing mechanism may be configured such that a top of each of the plurality of paper rolls is flattened into a flap. For example, a pair of plates may be configured to flatten the top of each of the plurality of paper rolls into a flap. Another example closing mechanism may be configured such that each of the flaps of each of the plurality of paper rolls is pressed into the top of each paper roll into a dimple. For example, an ejection system may be configured such that each of the flaps of each of the plurality paper rolls is pressed into a dimple into the top of each paper roll. Example closing mechanism configurations may also include a tray shuttle configured to transport the plurality of paper rolls between the closing mechanisms. Example closing mechanism configurations may also include a tray configured to removeably receive the plurality of paper rolls in rows. Example closing mechanism configurations may also include a weighing machine configured to weigh the material contained in each paper roll and determine a weight of the material contained in each paper roll. Example closing mechanism configurations may include one or more motors configured to cause the components to perform operational tasks such as, for example, rotate, extend, retract, actuate, and/or cause any of the components described herein to perform an associated desired operation.

The closing machine may be configured such that the one or more components are fixed to a support frame. In some examples, the support frame may be configured to arrange the components in a particular manner and/or may provide a fixed position for the components such that the components may be utilized together with precision. The closing machine may also be configured such that a user may utilize a display presenting a graphical user interface (GUI) to control the operation task, speed, and/or percentage of available power from the motor, and/or choose from various closing techniques there within. The closing machine may also be configured such that a user may utilize one or more buttons. The closing machine may be configured such that the paper rolls are routed from the closing machine and arranged in a storage or housing that may be separate from the closing machine.

The tray may be arranged in a number of ways. For example, the tray may be removeably received by the tray shuttle. Additionally, or alternatively, the tray may be fixed in the tray shuttle. The tray shuttle may be arranged in a number of ways. For example, the tray shuttle may be coupled to a rail system. Additionally, or alternatively, the tray shuttle may be displaceable in a first direction along the rail system. Additionally, or alternatively, the rail system may be fixed to a top surface of the support frame.

The tamping system may be arranged in a number of ways. For example, the tamping system may be secured to the support frame. Additionally, or alternatively, the tamping system may have a standalone support frame. Additionally, or alternatively, the tamping system may be arranged above the tray shuttle. Additional, or alternatively, the tamping system may include a plurality of tamping rods arranged in a row. Additionally, or alternatively, the plurality of tamping rods may be displaceable in a second direction perpendicular to the first direction along the rail system. Additionally, or alternatively, the tamping system may include one or more motors configured to actuate the plurality of tamping rods in the second direction.

The pair of plates may be arranged in a number of ways. For example, the pair of plate may be secured to the support frame. Additionally, or alternatively, the pair of plates may have a standalone support frame. Additionally, or alternatively, the pair of plates may be arranged above the tray shuttle. Additionally, or alternatively, the pair of plates may be arranged adjacent to the tamping system. Additionally, or alternatively, the pair of plates may be displaced between an open state and a closed state. Additionally, or alternatively, the pair of plates may be associated with one or more motors configured to actuate the pair of plates between the open state and the closed state. Additionally, or alternatively, the pair of plates may be actuated, via one or more motors, between the open state and the closed state simultaneously along with displacement of the plurality of tamping rods in the second direction perpendicular to the first direction along the rail system. Additionally, or alternatively, the pair of plates may be actuated, via one or more motors, between the open state and the closed state independently from the displacement of the plurality of tamping rods in the second direction perpendicular to the first direction along the rail system.

The ejection system may be arranged in a number of ways. For example, the ejection system may be secured to the support frame. Additionally, or alternatively, the ejection system may have a standalone support frame. Additionally, or alternatively, the ejection system may be arranged above the tray shuttle. Additionally, or alternatively, the ejection system may be arranged adjacent to the pair of plates. Additional, or alternatively, the ejection system may include a plurality of ejection rods arranged in a row. Additionally, or alternatively, the plurality of ejection rods may be displaceable in the second direction perpendicular to the first direction along the rail system. Additionally, or alternatively, the ejection system may include one or more motors configured to actuate the plurality of ejection rods in the second direction. Additionally, or alternatively, the ejection system may be actuated, via one or more motors, to be displaced in the second direction simultaneously along with the displacement of the plurality of tamping rods in the second direction perpendicular to the first direction along the rail system. Additionally, or alternatively, the ejection system may be actuated, via one or more motors, to be displaced in the second direction independently from the displacement of the plurality of tamping rods in the second direction perpendicular to the first direction along the rail system. Additionally, or alternatively, the ejection system may be actuated, via one or more motors, to be displaced in the second direction simultaneously along with displacement of the pair of plates between the open state and the closed state. Additionally, or alternatively, the ejection system may be actuated, via one or more motors, to be displaced in the second direction independently of the displacement of the pair of plates between the open state and the closed state.

In an example operation, the ejection system may displace the plurality of paper rolls out of the tray and onto a ramp. Additionally, or alternatively, the ejection system may displace the plurality of paper rolls out of the tray and into a packaging machine. The packaging machine may include an upright wheel removeably holding a plurality of packaging receptacles in a row. Additionally, or alternatively, the upright wheel may begin rotation such that respective lids of the plurality of packaging receptacles are closed such that the packaging receptacles containing respective ones of the plurality of paper rolls. Additionally, or alternatively, as the upright wheel continues to rotate the plurality of packing receptacles containing the plurality of paper rolls may be displaced into a container for transport.

The display may have at least one processor and at least one memory. Additionally, or alternatively, the display may be communicably coupled to one or more external computing devices. The memory may have instructions stored thereon causing the processor to perform one or more actions, such as, for example, presenting a Graphical User Interface (GUI) on the display. The GUI may be configured to accept input from a user to cause the closing machine to perform an action, such as, for example, displace, rotate, extend, retract, actuate, and/or cause any of the components described herein to perform an associated desired operation. Additionally, or alternatively, the GUI may be configured to accept input from a user to control the operation task, speed, and/or percentage of available power from the motor, and/or choose from various closing techniques there within or specify settings to create new closing techniques. The GUI may also be configured to power on and power off the closing machine. Other actions the closing machine may be able to perform are, for example, safety settings, on/off timer, and timed speed changes to form different paper cone closing techniques.

The one or more buttons may be configured to cause the closing machine to perform an immediate action upon actuation, without any additional processing. In examples, when a user physically actuates a button, the closing machine may be configured to cease all operation. In examples, the one or more buttons may be configured to perform one or more actions associated with the closing machine.

Take for example, an environment where a user desires to produce a number of paper rolls containing the material for repurpose use and/or sell as a prepackaged product that meets the industry standard. The user may load the tray with a plurality of paper rolls containing the material. The user may turn on the closing machine by pressing a button and/or actioning the display. The user may select the desired operation settings for the closing machine by touching the GUI elements presented on the display. The user may begin the automated operation of the closing machine by touching a GUI element presented on the display.

As operation begins, a motor associated with the tray shuttle coupled to a rail system may receive a signal and displace the tray shuttle in a first direction along the rail system to a position below the tamping system. A motor associated with the tamping system, the pair of plates, and/or the ejection system may then displace the plurality of tamping rods arranged in a row in a second direction perpendicular to the first direction for compacting the material contained in each of the paper rolls arranged in a first row down toward the bottom of each respective paper roll without overpacking the material. For example, the motor may displace the plurality of tamping rods up and down multiple times (e.g., about three times) to pack the material down toward the bottom of each respective paper roll arranged in the first row without over packing the material contained in each of the paper rolls. The motor coupled to the tray shuttle may then again displace the tray shuttle in the first direction along the rail system to a position below both of the tamping system and the pair of plates. The motor associated with the tamping system, the pair of plates, and/or the ejection system may then displace both of the plurality of tamping rods and the pair of plates in the second direction. The displaced plurality of tamping rods compacting the material contained in another set of paper rolls arranged in a second row adjacent to the paper rolls arranged in the first row while the displaced pair of plates simultaneously press on the top of each paper roll arranged in the first row to flatten the top of each paper roll into a flap. The motor coupled to the tray shuttle may then again displace the tray shuttle in the first direction along the rail system to a position below each of the tamping system, the pair of plates, and the ejection system. The motor associated with the tamping system, the pair of plates, and/or the ejection system may then displace each of the plurality of tamping rods, the pair of plates, and the plurality of ejection rods in the second direction. The displaced plurality of tamping rods compacting the material contained in another set of paper rolls arranged in a third row adjacent to the paper rolls arranged in the second row, while the displaced pair of plates simultaneously press on the top of each paper roll arranged in the second row to flatten the top of each paper roll into a flap and the plurality ejection rods press on the flap of each paper roll arranged in the first row to press the flap into the top of each paper roll into a dimple and displace the plurality of paper rolls arranged in the first row out of the tray.

The present disclosure provides an overall understanding of the principles of the structure, function, manufacture, and use of the systems and methods disclosed herein. One or more examples of the present disclosure are illustrated in the accompanying drawings. Those of ordinary skill in the art will understand that the systems and methods specifically described herein and illustrated in the accompanying drawings are non-limiting embodiments. The features illustrated or described in connection with one embodiment may be combined with the features of other embodiments, including as between systems and methods. Such modifications and variations are intended to be included within the scope of the appended claims.

Additional details are described below with reference to several example embodiments.

FIG. 1 illustrates a side view 100 of an example automated paper roll closing machine system (hereinafter, "the closing machine") 102. The closing machine 102 may include a tray 104 for removeably receiving a plurality of conically shaped paper rolls 106, in a row 108. While FIG. 1 illustrates the tray 104 includes six (6) rows of openings removeably receiving a plurality of conically shaped paper rolls, the tray 104 may have any number of rows of openings for removeably receiving a plurality of conically shaped paper rolls. Further, while FIG. 1 illustrates the tray 104 includes twelve (12) openings in each row removeably receiving a plurality of conically shaped paper rolls, each row may have any number of openings for removeably receiving a plurality of conically shaped paper rolls. Each conically shaped paper roll 106 having a top 110 opposite a bottom 112. The top 110 having a diameter 114 greater than a diameter 116 of the bottom 112. Each conically shaped paper roll 106 containing a processed agricultural material (hereinafter, "the material") 118. While FIG. 1 illustrates the shape of the conically shaped paper roll 106 may be substantially conical, other shapes are contemplated. For example, the shape of the paper rolls may be substantially cylindrical, right circular cylindrical, oblique circular cylindrical, right prism cylindrical, right rectangular cylindrical, etc. In some examples, each conically shaped paper roll 106 may be formed of a paper-like material 120(*a*). The paper-like material 120(*a*) may be comprised of at least one of refined white paper, unrefined brown paper, recycled paper, hemp paper, palm leaf, and/or anything containing substantially similar qualities. In some examples, each conically shaped paper roll 106 may include a support material 120(*b*) disposed therein. In some examples, the support material 120(*b*) may be substantially cylindrical and/or conical in shape. In some examples, the support material 120(*b*) may have a more favorable rigidity than the paper-like material 120(*a*) used to shape the conically shaped paper roll 106, such that the support material 120(*b*) provides substantial support for at least a portion of the conically shaped paper roll 106. In some examples, the support material 120(*b*) may be comprised of at least one of refined white paper, unrefined brown paper, recycled paper, hemp paper, palm leaf, and/or anything containing substantially similar qualities. Additionally, or alternatively, the support material 120(*b*) may be configured to obstruct the material while allowing for air to pass therethrough.

The closing machine 102 may include a support frame 122. The support frame 122 may provide support for the one or more components/implements of the closing machine 102. The support frame 122 may be configured such that the components may be arranged in various manners, such that the closing machine 102 may utilize various closing techniques, such as, for example, multiple closing operations executing simultaneously, closing of paper cones having various sizes, and/or closing operations executing at various speeds. In some examples, the support frame 122 may be connected across the entirety of the closing machine 102. Additionally, or alternatively, each individual component of the closing machine 102 may have a standalone support frame. The support frame 122 may be configured to support one or more motors 124(1), 124(2), and 124(*n*) for providing operational power to one or more components of the closing machine 102. In some examples, the one or more motors 124(1)-124(*n*) may be coupled to an individual component. Additionally, or alternatively, the closing machine 102 may utilize one motor for providing operational power to the components included therein. The one or more motors 124(1)-124(*n*) may be configured such that a user may specify a speed, such as, for example, a percentage of available power from the motor at which the motor will operate. In some examples, the motor may be configured to operate at any value from 0 to 100 percent of the available power from the motor, where 0 percent may be the lowest available power from the motor and 100 percent may be the highest available power from the motor. The motor may be configured such that it provides operational power to a number of components of the closing machine at the speed specified by the user.

The closing machine 102 may include a leadscrew 126 that may be arranged in a number of ways. For example, the leadscrew 126 may be secured to the support frame 122. Additionally, or alternatively, the leadscrew 126 may have a standalone support frame. In some examples, the leadscrew 126 may be configured to include a first end and a second end being opposite the first end. The leadscrew 126 may further be configured to travel in at least a first direction of travel and a second direction of travel. Additionally, or alternatively, the leadscrew 126 may be configured to rotate about its longitudinal axis. The leadscrew 126 may be actuated by the one or more motors **124(1)-124(*n*). For example, the leadscrew 126 may be caused to rotate about its longitudinal axis by motor 124(1)**.

The closing machine 102 may include a tray shuttle 128. The tray shuttle 128 may removeably receive the tray 104. For example, a user may place the tray 104 into the tray shuttle 128 and/or a user may remove the tray 104 from the tray shuttle 128. For example, a user may place the tray 104 into the tray shuttle 128 subsequent to the tray 104 being loaded with the plurality of conically shaped paper rolls 106 and/or a user may remove the tray 104 from the tray shuttle 128 subsequent to the plurality of conically shaped paper rolls 106 being ejected from the tray 104. The tray shuttle 128 may be coupled to a rail system 130. The rail system 130 may be arranged in a number of ways. For example, the rail system 130 may be secured to the support frame 122. Additionally, or alternatively, the rail system 130 may have a standalone support frame. The tray shuttle 128 may be displaceable in a first direction 132 along the rail system 130. For example, motor 124(1) may cause the leadscrew 126 to rotate about its longitudinal axis to cause the tray shuttle 128 to be displaced in the first direction 132 along the rail system 130.

The closing machine 102 may include a tamping system 134 that may be arranged in a number of ways. For example, the tamping system 134 may be arranged above the tray shuttle 128. Additionally, or alternatively, the tamping system 134 may be secured to the support frame 122. Additionally, or alternatively, the tamping system 134 may have a standalone support frame. The tamping system 134 may include a plurality of tamping rods 136 arranged in a row 138. The plurality of tamping rods 136 being displaceable in a second direction 140 perpendicular to the first direction 132 for compacting the material 118 contained in each of the conically shaped paper rolls 106 down toward the bottom 112 of each respective conically shaped paper roll 106. For example, the tray shuttle 128 may be displaced in the first direction 132 such that the row 108 of the plurality of conically shaped paper rolls 106 are positioned directly below the plurality of tamping rods 136 such that when the plurality of tamping rods 136 are displaced in the second direction 140, at least a portion of the plurality of tamping rods 136 contacts the material 118 contained in the plurality of conically shaped paper rolls 106 to tamp the material 118 down toward the bottom 112 of each respective conically shaped paper roll 106.

The closing machine 102 may include a leadscrew 142 that may be arranged in a number of ways. For example, the leadscrew 142 may be secured to the support frame 122. Additionally, or alternatively, the leadscrew 142 may have a standalone support frame. In some examples, the leadscrew 142 may be configured to include a first end and a second end being opposite the first end. The leadscrew 142 may further be configured to travel in at least a first direction of travel and a second direction of travel. Additionally, or alternatively, the leadscrew 142 may be configured to rotate about its longitudinal axis. The leadscrew 142 may be actuated by the one or more motors **124(1)-124(*n*). For example, the leadscrew 142 may be caused to rotate about its longitudinal axis by motor 124(2). Motor 124(2) may cause the lead screw 142 to rotate about its longitudinal axis to cause the plurality of tamping rods 136 to be displaced in the second direction 140. The tamping system 134 may include one or more pressure springs 144 arranged with the tamping rods 136. The one or more pressure springs 144 to prevent the plurality of tamping rods 136 from over pressuring the material 118 contained in the plurality of conically shaped paper rolls 106. For example, the one or more pressure springs 144 may be arranged between the leadscrew 142 and the plurality of tamping rods 136 to dampen the force applied by the leadscrew 142 to the plurality of tamping rods 136. The tamping system 134 may include one or more guide rods 146. The one or more guide rods 146 to guide the plurality of tamping rods 136 in the second direction 140 when the leadscrew 142 causes the plurality of tamping rods 136 to be displaced in the second direction 140**.

The closing machine 102 may include a pair of plates **148(*a*) and 148(*b*) that may be arranged in a number of ways. For example, the pair of plates 148(*a*) and 148(*b*) may be arranged above the tray shuttle 128 and adjacent to the plurality of tamping rods 136. Additionally, or alternatively, the pair of plates 148(*a*) and 148(*b*) may be secured to the support frame 122. Additionally, or alternatively, the pair of plates 148(*a*) and 148(*b*) may have a standalone support frame. The pair of plates 148(*a*) and 148(*b*) for pressing on the top 110 of each conically shaped paper roll 106 to flatten the top 110 of each conically shaped paper roll 106 into a flap. For example, subsequent to the plurality of tamping rods 136 tamping the material 118 down toward the bottom 112 of each respective conically shaped paper roll 106, the tray shuttle 128 may be displaced in the first direction 132 such that the row 108 of the plurality of conically shaped paper rolls 106 are positioned directly below the pair of plates 148(*a*) and 148(*b*) where the pair of plates 148(*a*) and 148(*b*) are displaced between an open state and a closed state to press (e.g., pinch, squeeze, squash, etc.) on the top of each conically shaped paper roll 106 to flatten the top 110 of each conically shaped paper roll 106** into a flap.

The closing machine 102 may include a leadscrew 150 that may be arranged in a number of ways. For example, the leadscrew 150 may be secured to the support frame 122. Additionally, or alternatively, the leadscrew 150 may have a standalone support frame. In some examples, the leadscrew 150 may be configured to include a first end and a second end being opposite the first end. The leadscrew 150 may further be configured to travel in at least a first direction of travel and a second direction of travel. Additionally, or alternatively, the leadscrew 150 may be configured to rotate about its longitudinal axis. The leadscrew 150 may be actuated by the one or more motors **124(1)-124(*n*). For example, the leadscrew 150 may be caused to rotate about its longitudinal axis by motor 124(*n*). Motor 124(*n*) may cause the leadscrew 150 to rotate about its longitudinal axis to cause the pair of plates 148(*a*) and 148(*b*) to be displaced between an open state and a closed state to flatten the top 110 of each conically shaped paper roll 106 into a flap. When in the open state, the pair of plates 148(*a*) and 148(*b*) are separated by a distance and when in the closed state, the pair of plates 148(*a*) and 148(*b*)** are in contact with each other.

The pair of plates 148(*a*) and 148(*b*) may include one or more guide pins 152. The one or more guide pins 152 to guide the pair of plates 148(*a*) and 148(*b*) between the open state and the closed state when the leadscrew 150 causes the pair of plates 148(*a*) and 148(*b*) to be displaced. The motor 124(*n*) may cause the leadscrew 150 to rotate about its longitudinal axis to cause the pair of plates 148(*a*) and 148(*b*) to be displaced between the open state and the closed state while the plurality of tamping rods 136 are displaced in the second direction 140. For example, the pair of plates 148(*a*) and 148(*b*) may be actuated, via motor 124(*n*), between the open state and the closed state simultaneously along with the displacement of the plurality of tamping rods 136 in the second direction 140.

The closing machine 102 may include an ejection system 154 that may be arranged in a number of ways. For example, the ejection system 154 may be arranged above the tray shuttle 128. Additionally, or alternatively, the ejection system 154 may be secured to the support frame 122. Additionally, or alternatively, the ejection system 154 may have a standalone support frame. The ejection system 154 may include a plurality of ejection rods 156 arranged in a row 158. The plurality of ejection rods 156 being displaceable in the second direction 140 perpendicular to the first direction 132 for pressing on the flap of each conically shaped paper roll 106 to press the flap into the top 110 of each conically shaped paper roll 106 into a dimple. For example, the tray shuttle 128 may be displaced in the first direction 132 such that the row 108 of the plurality of conically shaped paper rolls 106 are positioned directly below the plurality of ejection rods 156 such that when the plurality of ejection rods 156 are displaced in the second direction 140, at least a portion of the plurality of ejection rods 156 contacts the flap formed by the pair of plates 148(*a*) and 148(*b*) and press the flap into the top 110 of each conically shaped paper roll 106 into a dimple. Moreover, the plurality of ejection rods 156 being further displaceable in the second direction 140 perpendicular to the first direction 132 to displace the plurality of conically shaped paper rolls 106 out of the tray 104. For example, the plurality of ejection rods 156 may be displaced in the second direction to press the flap into the top 110 of each conically shaped paper roll 106 into a dimple and to eject the plurality of conically shaped paper rolls 106 out of the tray 104.

The tamping system 134, the pair of plates 148(*a*) and 148(*b*), and the ejection system 154 may be coupled together such that the tamping system 134, the pair of plates 148(*a*) and 148(*b*), and the ejection system 154 are displaced together in the second direction 140. For example, the tamping system 134, the pair of plates 148(*a*) and 148(*b*), and the ejection system 154 may be moveably coupled together on a support tower 160 fixed to the support frame 122. When the tray shuttle 128 is displaced in the first direction 132 such that the row 108 of the plurality of conically shaped paper rolls 106 are positioned directly below the plurality of tamping rods 136 (e.g., first stage), the plurality of tamping rods 136, the pair of plates 148(*a*) and 148(*b*), and the plurality of ejection rods 156 may be displaced together in the second direction 140 as the plurality of tamping rods 136 tamp the material 118 down toward the bottom 112 of each respective conically shaped paper roll 106. When the tray shuttle 128 is displaced in the first direction 132 such that the row 108 of the plurality of conically shaped paper rolls 106 are positioned directly below the pair of plates 148(*a*) and 148(*b*) (e.g., second stage), the plurality of tamping rods 136, the pair of plates 148(*a*) and 148(*b*), and the plurality of ejection rods 156 may be displaced together in the second direction 140 as the pair of plates 148(*a*) and 148(*b*) press on the top 110 of each conically shaped paper roll 106 to flatten the top 110 of each conically shaped paper roll 106 into a flap. Moreover, while the pair of plates 148(*a*) and 148(*b*) flatten the top 110 of each conically shaped paper roll 106, the plurality of tamping rods 136 simultaneously tamp the material in the plurality of conically shaped paper rolls arranged in the row adjacent to the conically shaped paper rolls being flattened by the pair of plates 148(*a*) and 148(*b*). When the tray shuttle 128 is displaced in the first direction 132 such that the row 108 of the plurality of conically shaped paper rolls 106 are positioned directly below the plurality of ejection rods 156 (e.g., third stage), the plurality of tamping rods 136, the pair of plates 148(*a*) and 148(*b*), and the plurality of ejection rods 156 may be displaced together in the second direction 140 as the plurality of ejection rods 156 press on the flap of each conically shaped paper roll 106 to press the flap into the top 110 of each conically shaped paper roll 106 into a dimple and eject the plurality of conically shaped paper rolls 106 out of the tray 104. Moreover, while the plurality of ejection rods 156 dimple and eject the plurality of conically shaped paper rolls 106, the plurality of tamping rods 136 simultaneously tamp the material in the plurality of conically shaped paper rolls arranged in the row adjacent to the conically shaped paper rolls being flattened by the pair of plates 148(*a*) and 148(*b*).

Figure 2:
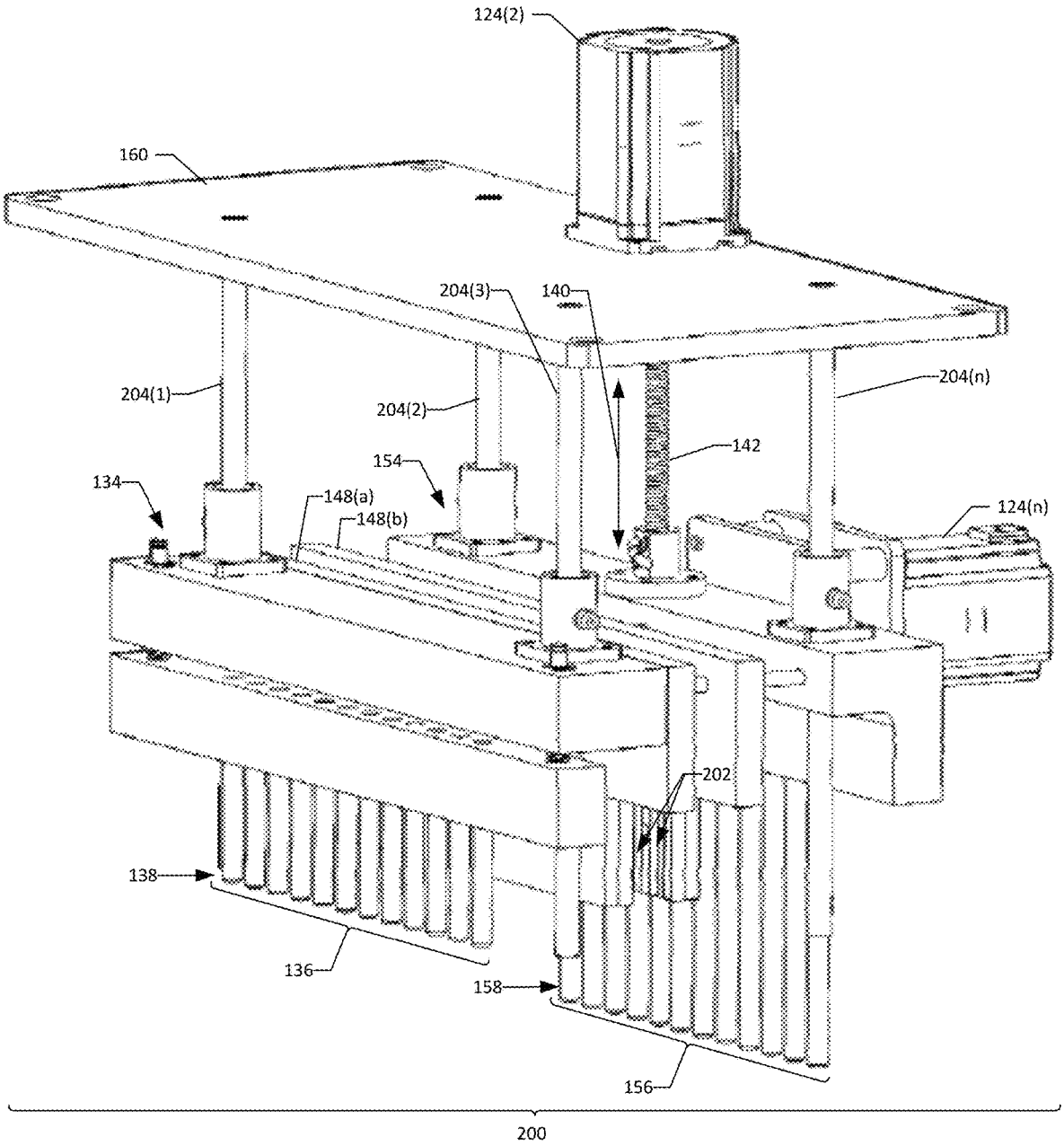
FIG. 2 illustrates a perspective view of a tamping system, a pair of plates, and an ejection system of the automated paper roll closing machine system of FIG. 1 coupled together according to an embodiment of the instant application.

FIG. 2 illustrates a perspective view 200 of the tamping system 134, the pair of plates 148(*a*) and 148(*b*), and the ejection system 154 coupled together without showing the tray 104, the support frame 122, and the tray shuttle 128 for the sake of clarity and is not intended to be limiting in any manner. FIG. 2 illustrates the plurality of tamping rods 136 arranged in the row 138. The plurality of tamping rods 136 may be arranged in the row 138 to match the plurality of conically shaped paper rolls 106 arranged in the row 108 in the tray 104. The pair of plates 148(*a*) and 148(*b*) may be arranged adjacent to the plurality of tamping rods 136 arranged in the row 138. The plurality of plates 148(*a*) and 148(*b*) may include cooperating serrations 202 disposed on opposing surfaces of the pair of plates 148(*a*) and 148(*b*) to provide for flattening the top of each conically shaped paper roll into a flap. FIG. 2 illustrates the plurality of ejection rods 156 arranged in the row 158 adjacent to the plurality of plates 148(*a*) and 148(*b*). Similar to the plurality of tamping rods 136, the plurality of ejection rods 156 may be arranged in the row 158 to match the plurality of conically shaped paper rolls 106 arranged in the row 108 in the tray 104. The plurality of tamping rods 136, the pair of plates 148(*a*) and 148(*b*), and/or the plurality of ejection rods 156 may be formed of a metal (e.g., steel, stainless steel, brass, aluminum, etc.). The tamping system 134, the pair of plates 148(*a*) and 148(*b*), and the ejection system 154 may be coupled together such that the plurality of tamping rods 136, the pair of plates 148(*a*) and 148(*b*), and/or the plurality of ejection rods 156 are displaced in the second direction 140 together simultaneously. For example, the tamping system 134, the pair of plates 148(*a*) and 148(*b*), and the ejection system 154 may be moveably coupled together via one or more guide rods 204(1), 204(2), 204(3), and 204(*n*) that guide the tamping system 134, the pair of plates 148(*a*) and 148(*b*), and the ejection system 154 simultaneously in the second direction 140. The tamping system 134, the pair of plates 148(*a*) and 148(*b*), and the ejection system 154 may be moveably coupled together via the one or more guide rods 204(1)-204(*n*) such that the plurality of tamping rods 136, the pair of plates 148(*a*) and 148(*b*), and/or the plurality of ejection rods 156 are each displaced simultaneously in the second direction 140 together when the motor 124(2) causes the leadscrew 142 to rotate about its longitudinal axis.

Figure 3:
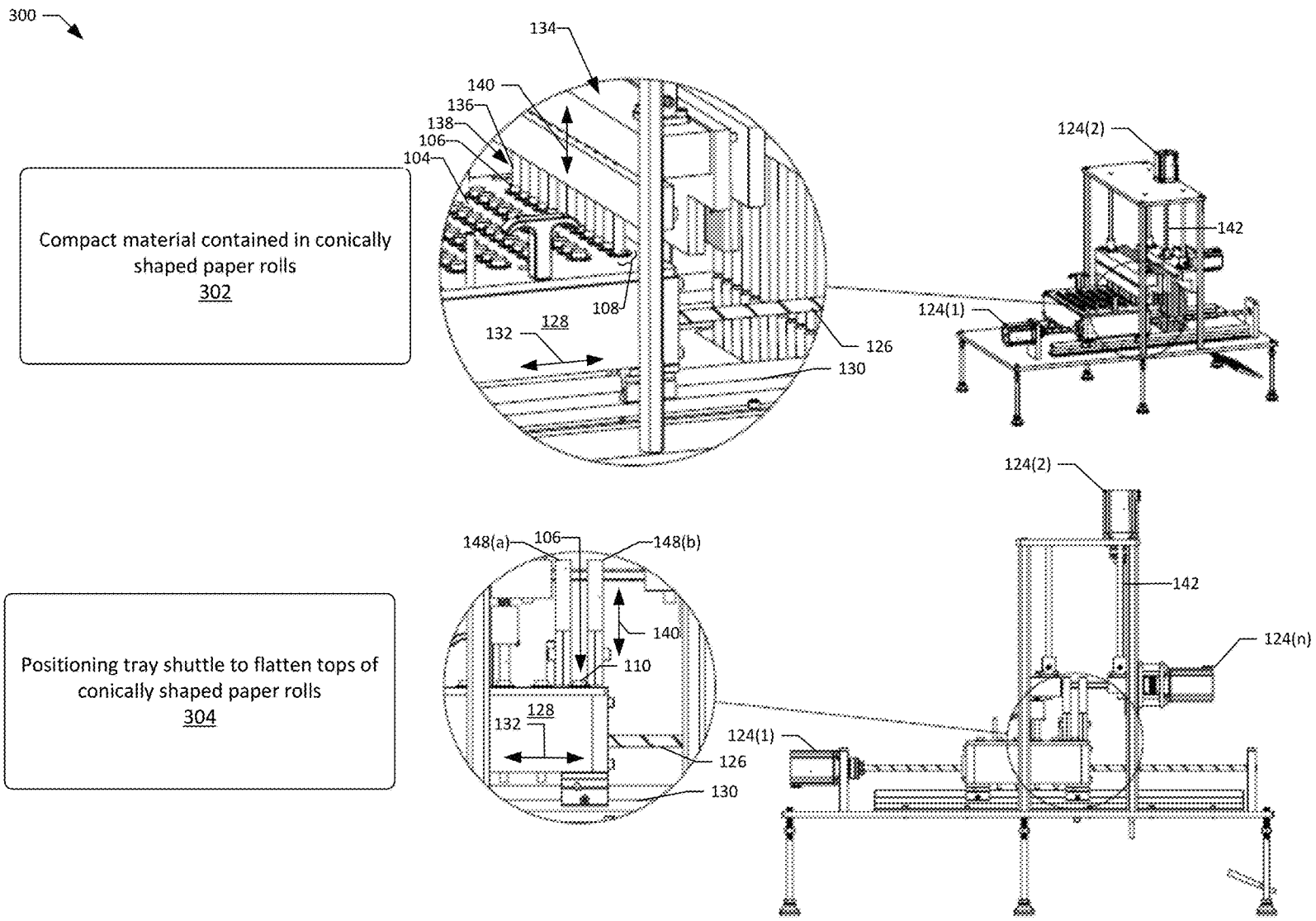
FIGS. 3 and 4 illustrate a flow diagram of an example process of the automated paper cone closing machine system of FIG. 1 for closing a plurality of conically shaped paper rolls alongside corresponding schematic diagrams illustrating the acts being described in the flow diagram according to an embodiment of the instant application.
Figure 4:
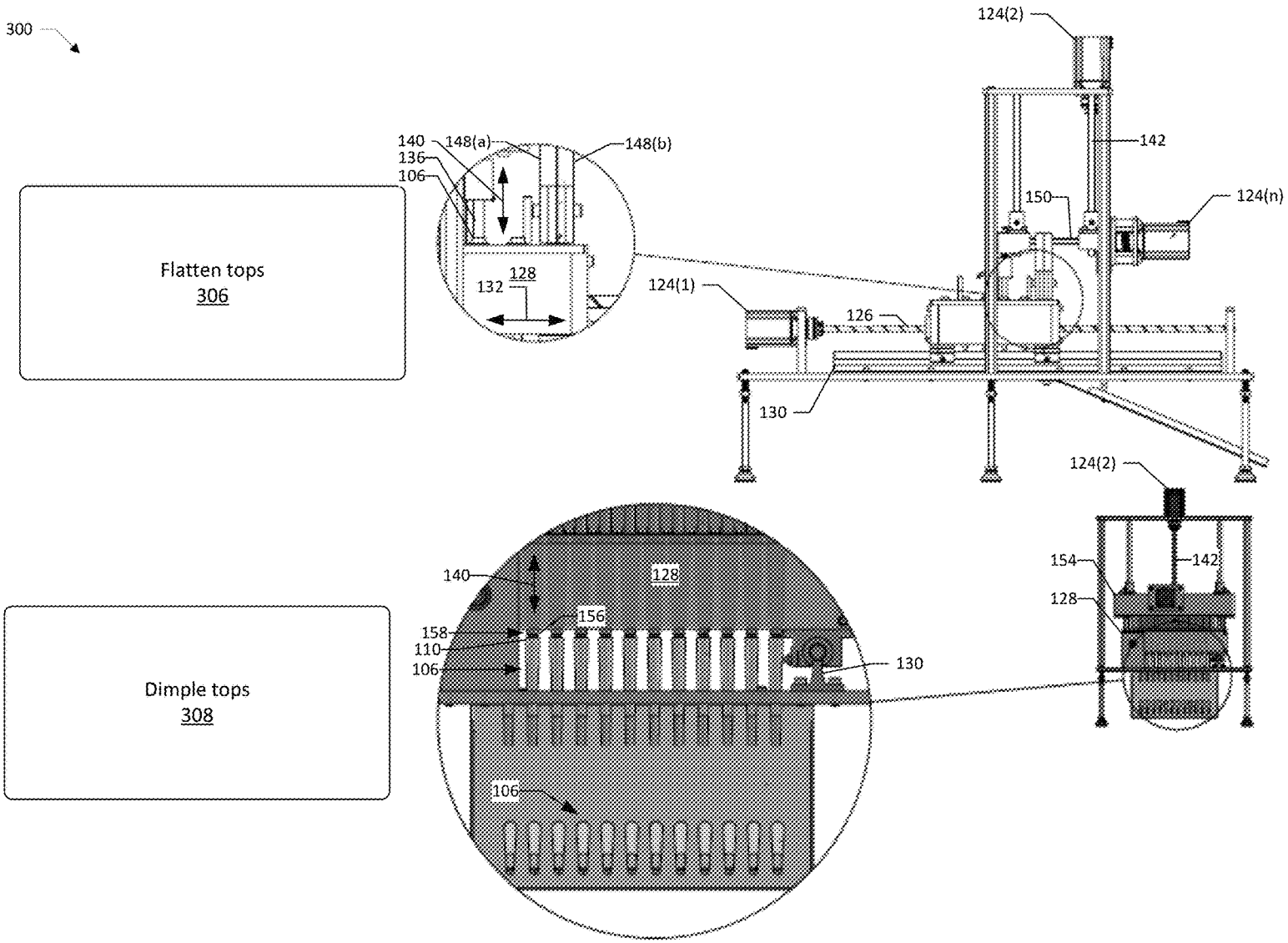

FIGS. 3 and 4 illustrate a flow diagram of an example process 300 of an automated paper cone closing machine system (e.g., automated paper roll closing machine system 102) for closing a plurality of conically shaped paper rolls (e.g., plurality of conically shaped paper rolls 106) alongside corresponding schematic diagrams illustrating the acts being described in the flow diagram according to an embodiment of the instant application. The process 300 may be for closing the plurality of conically shaped paper rolls arranged in a row (e.g., row 108) in a tray (e.g., tray 104) removeably received by a tray shuttle (e.g., tray shuttle 128). The processes described herein are illustrated as collections of blocks in logical flow diagrams, which represent a sequence of operations, some or all of which may be implemented in hardware, software or a combination thereof. In the context of software, the blocks may represent computer-executable instructions stored on one or more computer-readable media that, when executed by one or more processors, program the processors to perform the recited operations. Generally, computer-executable instructions include routines, programs, objects, components, data structures and the like that perform particular functions or implement particular data types. The order in which the blocks are described should not be construed as a limitation, unless specifically noted. Any number of the described blocks may be combined in any order and/or in parallel to implement the process, or alternative processes, and not all of the blocks need be executed. For discussion purposes, the processes are described with reference to the environments, architectures and systems described in the examples herein, such as, for example those described with respect to FIGS. 1 and 2, although the processes may be implemented in a wide variety of other environments, architectures and systems.

Process 300 includes an operation 302, which represents compacting a processed agricultural material (e.g., material 118) contained in each conically shaped paper roll (e.g., conically shaped paper roll 106). For example, a tamping system (e.g., tamping system 134) including a plurality of tamping rods (e.g., plurality of tamping rods 136) arranged in a row (e.g., row 138) and displaceable in a second direction (e.g., second direction 140) perpendicular to a first direction (e.g., first direction 132) may be actuated to compact the material contained in each of the conically shaped paper rolls down toward the bottom (e.g., bottom 112) of each respective conically shaped paper roll. Operation 302 may include a tray shuttle (e.g., tray shuttle 128) being displaced in the first direction such that the row of the plurality of conically shaped paper rolls are positioned directly below the plurality of tamping rods such that when the plurality of tamping rods are displaced in the second direction, at least a portion of the plurality of tamping rods contacts the material contained in the plurality of conically shaped paper rolls and tamp the material down toward the bottom of each respective conically shaped paper roll. Operation 302 may include operating a motor (e.g., motor 124(2)) to cause a leadscrew (e.g., leadscrew 142) to rotate about its longitudinal axis to cause the plurality of tamping rods to be displaced in the second direction. Operation 302 may include a user placing a tray (e.g., tray 104), loaded with the plurality of conically shaped paper rolls arranged in a row (e.g., row 108), into the tray shuttle. Operation 302 may include operating a motor (e.g., motor 124(1)) to cause a leadscrew (e.g., leadscrew 126) to rotate about its longitudinal axis to cause the tray shuttle to be displaced in the first direction along a rail system (e.g., rail system 130). In some examples, the user may turn on the closing machine by pressing a button and/or actioning a display. Additionally, or alternatively, the user may select a desired operation setting for the closing machine by touching GUI elements presented on a display. Additionally, or alternatively, the user may begin the automated operation of the closing machine by touching a GUI element presented on the display.

Process 300 may continue with operation 304, which represents positioning the tray shuttle to flatten the top (e.g., top 110) of each conically shaped paper roll into a flap. For example, the tray shuttle may be displaced in the first direction such that the row of the plurality of conically shaped paper rolls are positioned directly below and/or between a pair of plates (e.g., pair of plates 148(*a*) and 148(*b*)) in an open state. For example, operation 304 may include operating a motor (e.g., motor 124(1)) to cause a leadscrew (e.g., leadscrew 126) to rotate about its longitudinal axis to cause the tray shuttle to be displaced in the first direction along the rail system such that each top of each conically shaped paper roll are positioned directly below and/or between the pair of plates that are in an open state. Operation 304 may include operating a motor (e.g., motor 124(2)) to cause a leadscrew (e.g., leadscrew 142) to rotate about its longitudinal axis to cause the pair of plates in the open state to be displaced in the second direction such that the pair of plates are positioned adjacent to the tops of the conically shaped paper rolls arranged in the row.

Operation 304 may be followed by operation 306, which represents flattening the tops of the conically shaped paper rolls arranged in the row. Operation 306 may include operating a motor (e.g., motor 124(*n*)) to cause a leadscrew (e.g., leadscrew 150) to rotate about its longitudinal axis to cause the pair of plates to be displaced from the open state to a closed state to flatten the top of each conically shaped paper roll into a flap. Operation 306 may include operating a motor (e.g., motor 124(2)) to cause a leadscrew (e.g., leadscrew 142) to rotate about its longitudinal axis to cause the pair of plates to be displaced in the second direction while simultaneously operating the motor (e.g., motor 124(*n*)) to cause the leadscrew (e.g., leadscrew 150) to rotate about its longitudinal axis to cause the pair of plates to be displaced from the open state to the closed state to flatten the top of each conically shaped paper roll into a flap. Operation 306 may further include operating the motor (e.g., motor 124(2)) to cause the leadscrew (e.g., leadscrew 142) to rotate about its longitudinal axis to cause the plurality of tamping rods to be displaced in the second direction and tamp the material contained in adjacent conically shaped paper rolls while simultaneously operating the motor (e.g., motor 124(*n*)) to cause the leadscrew (e.g., leadscrew 150) to rotate about its longitudinal axis to cause the pair of plates to be displaced from the open state to the closed state to flatten the top of each conically shaped paper roll into a flap. Operation 306 may include operating the motor (e.g., motor 124(2)) to cause the leadscrew (e.g., leadscrew 142) to rotate about its longitudinal axis to cause the plurality of tamping rods to be displaced in the second direction up and down consecutively three (3) times to tamp the material contained in the conically shaped paper rolls. Operation 306 may further include ceasing the displacement of the tamping rods for a period of time while the plurality of tamping rods are positioned down in the conically shaped paper rolls simultaneously while the pair of plates are displaced in the closed state and flattening the tops of each conically shaped paper roll into a flap.

Process 300 may be completed at operation 308, which represents dimpling the tops of the conically shaped paper rolls. For example, an ejection system (e.g., ejection system 154) including a plurality of ejection rods (e.g., ejection rods 156) arranged in a row (e.g., row 158) and displaceable in the second direction (e.g., second direction 140) perpendicular to the first direction (e.g., first direction 132) may be actuated to press on the flap of each conically shaped paper roll and presses the flap into the top of each conically shaped paper roll into a dimple. For example, the tray shuttle may be displaced in the first direction such that the row of the plurality of conically shaped paper rolls are positioned directly below the plurality of ejection rods such that when the plurality of ejection rods are displaced in the second direction, at least a portion of the plurality of ejection rods press on the flap of each conically shaped paper roll and presses the flap into the top of each conically shaped paper roll into a dimple. Operation 308 may include operating a motor (e.g., motor 124(2)) to cause a leadscrew (e.g., leadscrew 142) to rotate about its longitudinal axis to cause the plurality of ejection rods to be displaced in the second direction. Operation 308 may include operating a motor (e.g., motor 124(1)) to cause a leadscrew (e.g., leadscrew 126) to rotate about its longitudinal axis to cause the tray shuttle to be displaced in the first direction along the rail system (e.g., rail system 130) such that the row of the plurality of conically shaped paper rolls are positioned directly below the plurality of ejection rods. Operation 308 may include operating the motor (e.g., motor 124(2)) to cause a leadscrew (e.g., leadscrew 142) to rotate about its longitudinal axis to cause the plurality of ejection rods to be displaced in the second direction to displace the plurality of conically shaped paper rolls out of the tray and onto an ejection ramp. The ejected conically shaped paper rolls being fully closed and containing the material for repurpose use.

As used herein, a processor, may include multiple processors and/or a processor having multiple cores. Further, the processors may comprise one or more cores of different types. For example, the processors may include application processor units, graphic processing units, and so forth. In one implementation, the processor may comprise a microcontroller and/or a microprocessor. Alternatively, or in addition, the functionally described herein may be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, the processor(s) may possess its own local memory, which also may store program components, program data, and/or one or more operating systems.

The memory may include volatile and nonvolatile memory, removable and non-removable media implemented in any method or technology for storage of information, such as computer-readable instructions, data structures, program component, or other data. Such memory includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which may be used to store the desired information and which may be accessed by a computing device. The memory may be implemented as computer-readable storage media ("CRSM"), which may be any available physical media accessible by the processor(s) to execute instructions stored on the memory. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other tangible medium which may be used to store the desired information, and which may be accessed by the processor(s).

Figure 5:
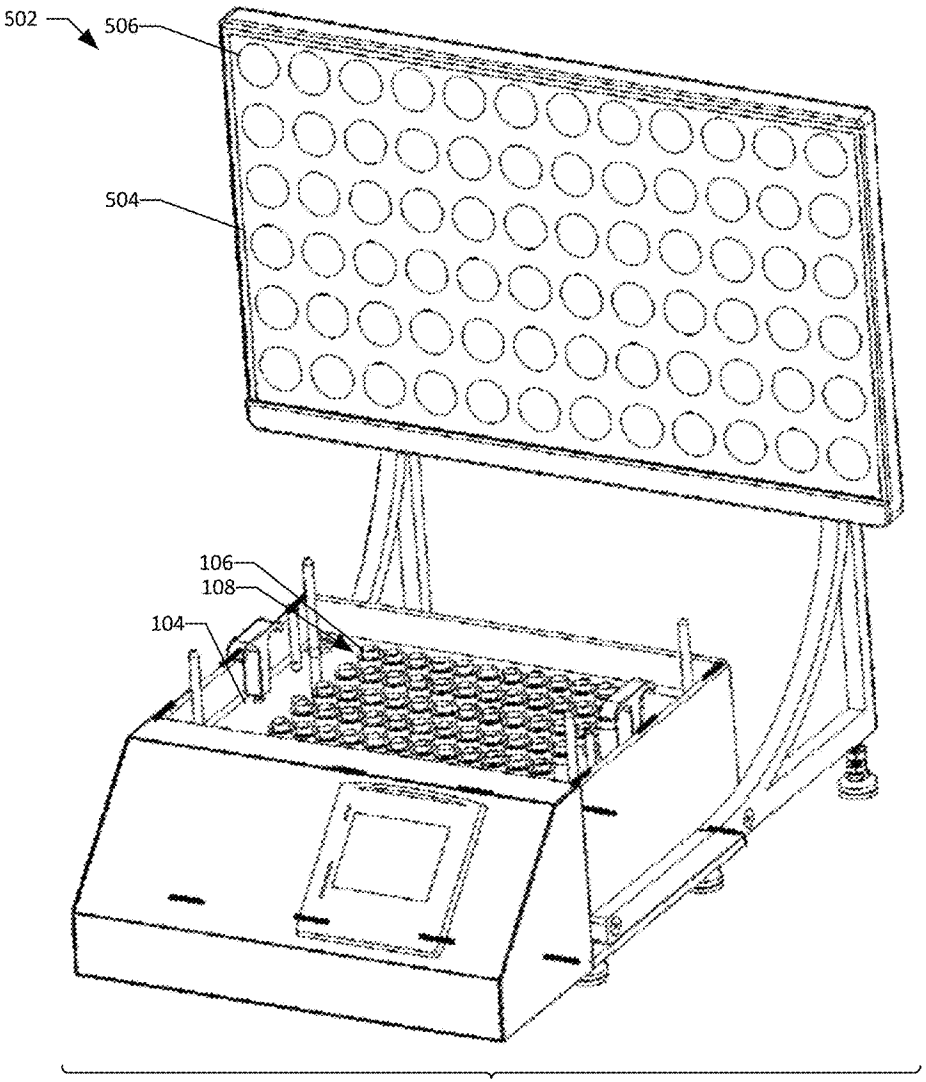
FIG. 5 illustrates an example weighing machine arrangeable with the automated paper cone closing machine system in FIG. 1 according to an embodiment of the instant application.

FIG. 5 illustrates a perspective view 500 of an example weighing machine 502. The weighing machine 502 may be arranged with the closing machine 102. The weighing machine 502 may removeably receive the tray 104 including the plurality of conically shaped paper rolls 106 arranged in rows 108. For example, a user may place the tray 104 into the weighing machine 502 subsequent to the tray 104 being loaded with the plurality of conically shaped paper rolls 106 to determine if a desired amount of the material 118 is contained in each conically shaped paper roll. For example, the weighing machine 502 may include a plurality of load cells arranged in the weighing machine 502 and configured to determine a desired weight of the material contained in each conically shaped paper roll. The load cells may be arranged in one or more rows similar to the rows arranged in the tray 104. Each load cell for weighing the material contained in each conically shaped paper roll 106. The weighing machine 502 being capable of determining a weight of the material contained in each conically shaped paper roll 106. While FIG. 5 illustrates the weighing machine 502 includes six (6) rows of load cells for weighing a plurality of conically shaped paper rolls, the weighing machine 502 may have any number of rows of load cells. Further, while FIG. 5 illustrates the weighing machine 502 includes twelve (12) load cells in each row for weighing a plurality of conically shaped paper rolls, each row may have any number of load cells for weighing a plurality of conically shaped paper rolls. The weighing machine 502 including a display 504 configured to present the respective weight of the material contained in each conically shaped paper roll. The display 504 displaying a pass/fail (e.g., go/no go) indication to a user. For example, the display 504 may present a plurality of pass/fail icons 506 representing each conically shaped paper roll received in rows in the tray 104. The display 504 may present a first type of icon (e.g., green colored icon, "yes" marked icon, thumbs up icon, etc.) indicating the respective conically shaped paper roll contains the desired amount of material. The display 504 may present a second type of icon (e.g., red colored icon, "no" marked icon, thumbs down icon, etc.) indicating the respective conically shaped paper roll does not contain the desired amount of material. While FIG. 5 illustrates the display 504 presenting pass/fail indications to a user, the display 504 may present respective numeric weight value indications to a user. If the weighing machine 502 determines one or more of the plurality of conically shaped paper rolls fails to contain the desired amount of material and has less than the desired amount of material, a user may proceed to add additional material to the conically shaped paper roll such that the conically shaped paper roll does containing the desired amount of material. If one or more of the plurality of conically shaped paper rolls fails to contain the desired amount of material and has more than the desired amount of material, a user may proceed to remove material from the conically shaped paper roll such that the conically shaped paper roll contains the desired amount of material. Subsequent to the weighing machine 502 indicating that the plurality of conically shaped paper rolls each contain the desired amount of material, a user may remove the tray 104 from the weighing machine 502 and place the tray 104 into the tray shuttle 128 for compacting and closing the conically shaped paper rolls containing the desired amount of material.

Figure 6:
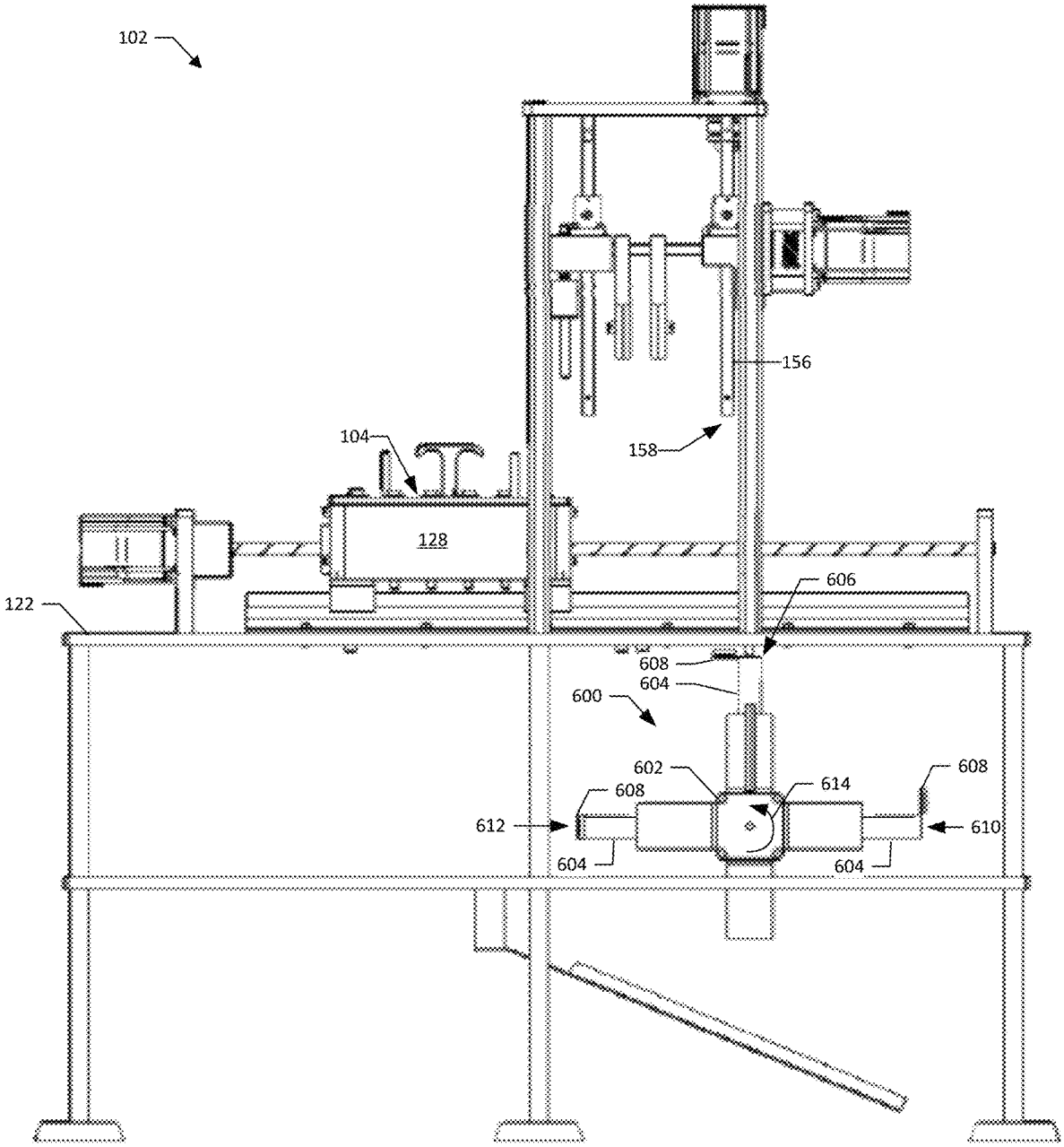
FIG. 6 illustrates an example closing machine arranged with the automated paper roll closing machine system of FIG. 1 according to an embodiment of the instant application.

FIG. 6 illustrates an example packaging machine 600 arranged with the automated paper roll closing machine system 102 of FIG. 1 according to an embodiment of the instant application. The packaging machine 600 may be arranged with the plurality of ejection rods 156. For example, the packaging machine 600 may be arranged directly below the plurality of ejection rods 156. The packaging machine 600 may include an upright wheel 602. The upright wheel 602 for removeably holding a plurality of packaging receptacles 604 in a row 606. For example, the upright wheel 602 may include a plurality of openings configured to hold the plurality of packaging receptacles 604 in a row that substantially matches the plurality of conically shaped paper rolls 106 arranged in the row 108. The plurality of packaging receptacles 604 for receiving the plurality of conically shaped paper rolls 106 displaced out of the tray 104. Each of the packaging receptacles 604 including a lid 608 displaceable between an open position 610 and a closed position 612. When the upright wheel 602 rotates 614, the packaging machine 600 displaces the lid 608 from the open position 610 to the closed position 612 subsequent to the plurality of conically shaped paper rolls 106 being received by the plurality of packaging receptacles 604.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims.

What is claimed is:

1. A system comprising:

a tray for removeably receiving a plurality of conically shaped paper rolls, respective conically shaped paper rolls having a top opposite a bottom, the top having a first diameter greater than a second diameter of the bottom, and the respective conically shaped paper rolls containing a material;

a rail system;

a tray shuttle coupled to the rail system, the tray shuttle removeably receiving the tray and being displaceable in a first direction along the rail system;

one or more plates arranged above the tray shuttle, the one or more plates being displaceable between an open state and a closed state for pressing on the top of the respective conically shaped paper rolls; and an ejection system arranged above the tray shuttle, the ejection system including a plurality of ejection rods arranged adjacent to the one or more plates, the plurality of ejection rods being displaceable in a second direction perpendicular to the first direction to press on the top of the respective conically shaped paper rolls to displace the plurality of conically shaped paper rolls out of the tray.

2. The system of claim 1, wherein the one or more plates are displaceable in the second direction, such that the one or more plates are displaced adjacent to the top of the respective conically shaped paper rolls to press on the top of the respective conically shaped paper rolls.

3. The system of claim 1, wherein the one or more plates press on the top of the respective conically shaped paper rolls to flatten the top of the respective conically shaped paper rolls into a flap.

4. The system of claim 3, wherein the plurality of ejection rods are displaceable in the second direction to press the flap into the top of the respective conically shaped paper rolls into a dimple.

5. The system of claim 1, wherein the one or more plates and the ejection system are moveably coupled together via one or more guide rods such that the one or more guide rods guide the one or more plates and the ejection system together simultaneously in the second direction.

6. The system of claim 1, further comprising:

a first motor and a first leadscrew, the first motor configured to cause the first leadscrew to rotate to displace the tray shuttle in the first direction, a second motor and a second leadscrew, the second motor configured to cause the second leadscrew to rotate to displace the one or more plates and the plurality of ejection rods in the second direction; and a third motor and a third leadscrew, the third motor configured to cause the third leadscrew to rotate to displace the one or more plates between the open state and the closed state.

7. The system of claim 1, wherein the one or more plates includes serrations disposed on opposing surfaces of the one or more plates for pressing on the top of a respective conically shaped paper roll of the plurality of conically shaped paper rolls.

8. The system of claim 1, further comprising a weighing machine including a plurality of load cells, a respective load cell for weighing the material contained in the respective conically shaped paper rolls, and the weighing machine determining a weight of the material contained in the respective conically shaped paper rolls.

9. A system comprising:

a rail system;

a tray shuttle coupled to the rail system, the tray shuttle being configured to receive a tray and being displaceable in a first direction along the rail system;

one or more plates arranged above the tray shuttle, the one or more plates being displaceable between an open state and a closed state for pressing on a top of each paper roll of a plurality of paper rolls received in the tray to flatten the top of each paper roll into a flap; and a plurality of ejection rods arranged above the tray shuttle, the plurality of ejection rods being displaceable in a second direction perpendicular to the first direction to press on the flap of each paper roll to displace the plurality of paper rolls out of the tray.

10. The system of claim 9, wherein the one or more plates are displaceable in the second direction such that the one or more plates are displaced adjacent to the top of each paper roll to press on the top of each paper roll.

11. The system of claim 9, wherein the plurality of ejection rods are displaceable in the second direction to press the flap into a top of each paper roll into a dimple.

12. The system of claim 9, wherein the one or more plates and the plurality of ejection rods are each moveably coupled together via one or more guide rods such that the one or more guide rods guide the one or more plates and the plurality of ejection rods together simultaneously in the second direction.

13. The system of claim 9, further comprising:

a first motor and a first leadscrew, the first motor configured to cause the first leadscrew to rotate to displace the tray shuttle in the first direction, a second motor and a second leadscrew, the second motor configured to cause the second leadscrew to rotate to displace the one or more plates and the plurality of ejection rods in the second direction; and a third motor and a third leadscrew, the third motor configured to cause the third leadscrew to rotate to displace the one or more plates between the open state and the closed state.

14. The system of claim 9, wherein the one or more plates includes cooperating serrations disposed on opposing surfaces of the one or more plates for pressing on the top of each paper roll of the plurality of paper rolls.

15. The system of claim 9, further comprising a weighing machine including a plurality of load cells, each load cell for weighing a material contained in each paper roll, and the weighing machine determining a weight of the material contained in each paper roll.

16. A system comprising:

a tray shuttle configured to translate in a first direction;

one or more plates arranged above the tray shuttle, the one or more plates being configured to translate in a second direction perpendicular to the first direction such that the one or more plates are displaced adjacent to a top of each paper roll for pressing on the top of each paper roll to flatten the top of each paper roll into a flap; and a plurality of ejection rods arranged above the tray shuttle, the plurality of ejection rods being configured to translate in the second direction to press on the flap of each paper roll to displace each paper roll out of a tray removeably received within the tray shuttle.

17. The system of claim 16, wherein the one or more plates and the plurality of ejection rods are each moveably coupled together via one or more guide rods such the one or more guide rods guide the one or more plates and the plurality of ejection rods together simultaneously in the second direction.

18. The system of claim 17, wherein the one or more plates are displaceable between an open state and a closed state for pressing on the top of each paper roll to flatten the top of each paper roll into the flap, further comprising:

a first motor and a first leadscrew, the first motor configured to cause the first leadscrew to rotate to displace the tray shuttle in the first direction, a second motor and a second leadscrew, the second motor configured to cause the second leadscrew to rotate to displace the one or more plates and the plurality of ejection rods in the second direction; and a third motor and a third leadscrew, the third motor configured to cause the third leadscrew to rotate to displace the one or more plates between the open state and the closed state.

19. The system of claim 16, further comprising a weighing machine including a plurality of load cells, each load cell for weighing a material contained in each paper roll, and the weighing machine determining a weight of the material contained in each paper roll.

20. The system of claim 16, wherein the plurality of ejection rods translate in the second direction to press the flap into the top of each paper roll into a dimple.

* * * * *